US007442069B2

(12) United States Patent
Jing

(10) Patent No.: US 7,442,069 B2
(45) Date of Patent: Oct. 28, 2008

(54) ORIENTING STRUCTURE FOR CONNECTING MALE CONNECTOR AND FEMALE CONNECTOR AND DISPLAY DEVICE USING THE SAME

(75) Inventor: Xiao-Hong Jing, Shenzhen (CN)

(73) Assignees: Innocom Technology (Shenzhen) Co., Ltd., Shenzhen, Guangdong Province (CN); Innolux Display Corp., Miao-Li County (TW)

( * ) Notice: Subject to any disclaimer, the term of this patent is extended or adjusted under 35 U.S.C. 154(b) by 0 days.

(21) Appl. No.: 11/985,119

(22) Filed: Nov. 13, 2007

(65) Prior Publication Data

US 2008/0113547 A1 May 15, 2008

(30) Foreign Application Priority Data

Nov. 10, 2006 (TW) ..... 95141782 A

(51) Int. Cl.
*H01R 24/14* (2006.01)

(52) U.S. Cl. ..... 439/374

(58) Field of Classification Search ..... 439/374, 439/246–248, 310, 32, 131
See application file for complete search history.

(56) References Cited

U.S. PATENT DOCUMENTS 4,941,841 A * 7/1990 Darden et al. ..... 361/685
5,009,384 A * 4/1991 Gerke et al. ..... 248/343
5,327,323 A * 7/1994 Yeom et al. ..... 361/685
5,743,755 A * 4/1998 Aoki ..... 439/354
5,919,057 A * 7/1999 Kameyama ..... 439/364
6,027,378 A * 2/2000 Abe et al. ..... 439/701
6,322,389 B1 * 11/2001 Reese et al. ..... 439/553
6,786,750 B2 * 9/2004 Itoh ..... 439/247
6,830,469 B1 * 12/2004 Doyle et al. ..... 439/247
7,128,348 B2 10/2006 Kawamura et al.
7,344,409 B2 * 3/2008 Lang et al. ..... 439/607
7,390,207 B2 * 6/2008 Noguchi et al. ..... 439/248

* cited by examiner

*Primary Examiner*—Alexander Gilman
(74) *Attorney, Agent, or Firm*—Wei Te Chung

(57) ABSTRACT

An exemplary orienting structure includes two locating units, a first supporting bump, and a second supporting bump. Each of the locating units includes a first portion and a second portion perpendicular to the first portion. The first supporting bump and the locating units cooperatively define a sliding track configured for slidingly receiving a male connector. A female connector is disposed on the second supporting bump and aligned with the sliding track. The first portions of the locating units function as guides for blocking movement along a first axis of the sliding track. The first supporting bump in cooperation with the second portions of the locating units function as guides for blocking movement along a second axis of the sliding track. When the male connector is slid along the sliding track, the sliding is in a direction perpendicular to both the first and second axes of the sliding track.

20 Claims, 7 Drawing Sheets

ORIENTING STRUCTURE FOR CONNECTING MALE CONNECTOR AND FEMALE CONNECTOR AND DISPLAY DEVICE USING THE SAME

FIELD OF THE INVENTION

The present invention relates to an orienting structure for connecting a male electrical connector and a female electrical connector together, and a display device using the orienting structure.

GENERAL BACKGROUND

Two common kinds of display devices are cathode ray tube (CRT) monitors and liquid crystal display (LCD) monitors. These display devices typically include a main male electrical connector and a main female electrical connector for electrically connecting two different main units together.

FIG. 5 is an exploded, isometric view of a conventional display device. The display device 1 includes a front cover 11, a display module 12, a power supply circuit 13, a shield case 14, a cable 15, and a rear cover 16. The front cover 11 coupled with the rear cover 16 defines a closed space there between. The display module 12, the power supply circuit 13, the shield case 14, and the cable 15 are received in the closed space.

The power supply circuit 13 is disposed between the display module 12 and the shield case 14. The power supply circuit 13 is electrically coupled to the display module 12 by the cable 15. The display module 12 includes a backboard 120, and a printed circuit board 121 disposed on the backboard 120. The printed circuit board 121 includes a female electrical connector 123.

Referring also to FIG. 6, this is an exploded, isometric view of certain parts only of the display device 1. The female connector 123 includes a rectangular groove 125, and a plurality of contact fingers 127 formed at inner surfaces of the groove 125. One terminal of the cable 15 includes a male electrical connector 152 corresponding to the female connector 123 of the printed circuit board 121. The male connector 152 includes a rectangular protrusion 153 corresponding to the groove 125 of the female connector 123. The rectangular protrusion 153 includes a plurality of contact fingers 154 corresponding to the contact fingers 127 of the female connector 123. The contact fingers 154 are formed at outer surfaces of the rectangular protrusion 153.

Referring also to FIG. 7, this is an assembled view of the parts of the display device 1 shown in FIG. 6. The rectangular protrusion 153 of the male connector 152 is inserted into the groove 125 of the female connector 123. The contact fingers 154 of the rectangular protrusion 153 of the male connector 152 contact the contact fingers 127 at the groove 125 of the female connector 123. Thereby, the printed circuit board 121 of the display module 12 is electrically coupled to the power supply circuit 13 by the female connector 123 and the male connector 152.

The rectangular protrusion 153 of the male connector 152 is exactly matched with the groove 125 of the female connector 123. That is, the size of the protrusion 153 of the male connector 152 is substantially equal to the size of the groove 125 of the female connector 123. In addition, there may be other elements (not shown) inside or beside the groove 125 of the female connector 123. As a result, in assembly of the display device 1, it may be difficult for the male connector 152 to be located correctly in position relative to the female connector 123. That is, insertion of the protrusion 153 of the male connector 152 into the groove 125 of the female connector 123 may be inconvenient and time-consuming. This increases the difficulty of assembling the display device 1.

Furthermore, if the protrusion 153 of the male connector 152 is inserted into the groove 125 of the female connector 123 incorrectly, the contact fingers 127, 154 of the male and female connectors 152, 123 may be damaged. As a result, various of the contact fingers 154 of the male connector 152 may not properly contact the corresponding contact fingers 127 of the female connector 123, or there may be no contact whatsoever. When this happens, power signals cannot be reliably transmitted to the display module 12 from the power supply circuit 13, or cannot be transmitted at all. That is, the display device 1 operates incorrectly, or fails to operate at all.

What is needed, therefore, is a means of overcoming the above-described deficiencies.

SUMMARY

An orienting structure is provided for facilitating connecting a male electrical connector and a female electrical connector together. The orienting structure includes two locating units, a first supporting bump, and a second supporting bump spaced a same distance from the first supporting bump and the locating units. Each of the locating units includes a first portion and a second portion perpendicular to the first portion. The first supporting bump is disposed between the first portions of the locating units, and below the second portions of the locating units. The first supporting bump and the locating units cooperatively define a sliding track configured for glidingly receiving the male connector. The female connector is disposed on the second supporting bump and aligned with the sliding track. The first portions of the locating units function as guides for blocking movement along a first axis of the sliding track. The first supporting bump in cooperation with the second portions of the locating units function as guides for blocking movement along a second axis of the sliding track. The first direction is perpendicular to the second direction. When the male connector is slid along the sliding track, the sliding is in a direction perpendicular to both the first and second axes of the sliding track.

A display device includes a backboard, a female connector, a male connector, and an orienting structure disposed on the backboard. The orienting structure includes two locating units, a first supporting bump disposed at the backboard, and a second supporting bump disposed at the backboard and spaced a same distance from the first supporting bump and the locating units. Each of the locating units includes a first portion and a second portion perpendicular to the first portion. The first supporting bump is disposed between the first portions of the locating units, and below the second portions of the locating units. The first supporting bump and the locating units cooperatively define a sliding track configured for glidingly receiving the male connector. The female connector is disposed on the second supporting bump and aligned with the sliding track. The first portions of the locating units function as guides for blocking movement along a first axis of the sliding track. The first supporting bump in cooperation with the second portions of the locating units function as guides for blocking movement along a second axis of the sliding track. The first direction is perpendicular to the second direction. When the male connector is slid toward the female connector along the sliding track, the sliding is in a direction perpendicular to both the first and second axes of the sliding track.

A display device includes a backboard, a female connector, a male connector, and an orienting structure disposed on the backboard. The orienting structure includes two locating units, a first supporting bump disposed at the backboard, and a second supporting bump disposed at the backboard and spaced a same distance from the first supporting bump and the locating units. Each of the locating units includes a first portion and a second portion perpendicular to the first portion. The first supporting bump is disposed between the first portions of the locating units, and below the second portions of the locating units. The first supporting bump and the locating units cooperatively define a sliding track configured for glidingly receiving the male connector. The female connector is disposed on the second supporting bump and aligned with the sliding track. The first portions of the locating units function as guides for blocking movement along a first axis of the sliding track. The first supporting bump in cooperation with the second portions of the locating units function as guides for blocking movement along a second axis of the sliding track. The first direction is perpendicular to the second direction. The male connector is slid toward the female connector along the sliding track, the sliding is in a direction perpendicular to both the first and second axes of the sliding track. When the male connector is connected to the female connector, the male connector is held in position by the locating units and the first supporting bump.

Other novel features and advantages will become more apparent from the following detailed description when taken in conjunction with the accompanying drawings.

DETAILED DESCRIPTION OF PREFERRED EMBODIMENTS

Reference will now, be made to the drawings to describe preferred and exemplary embodiments in detail.

Figure 1:
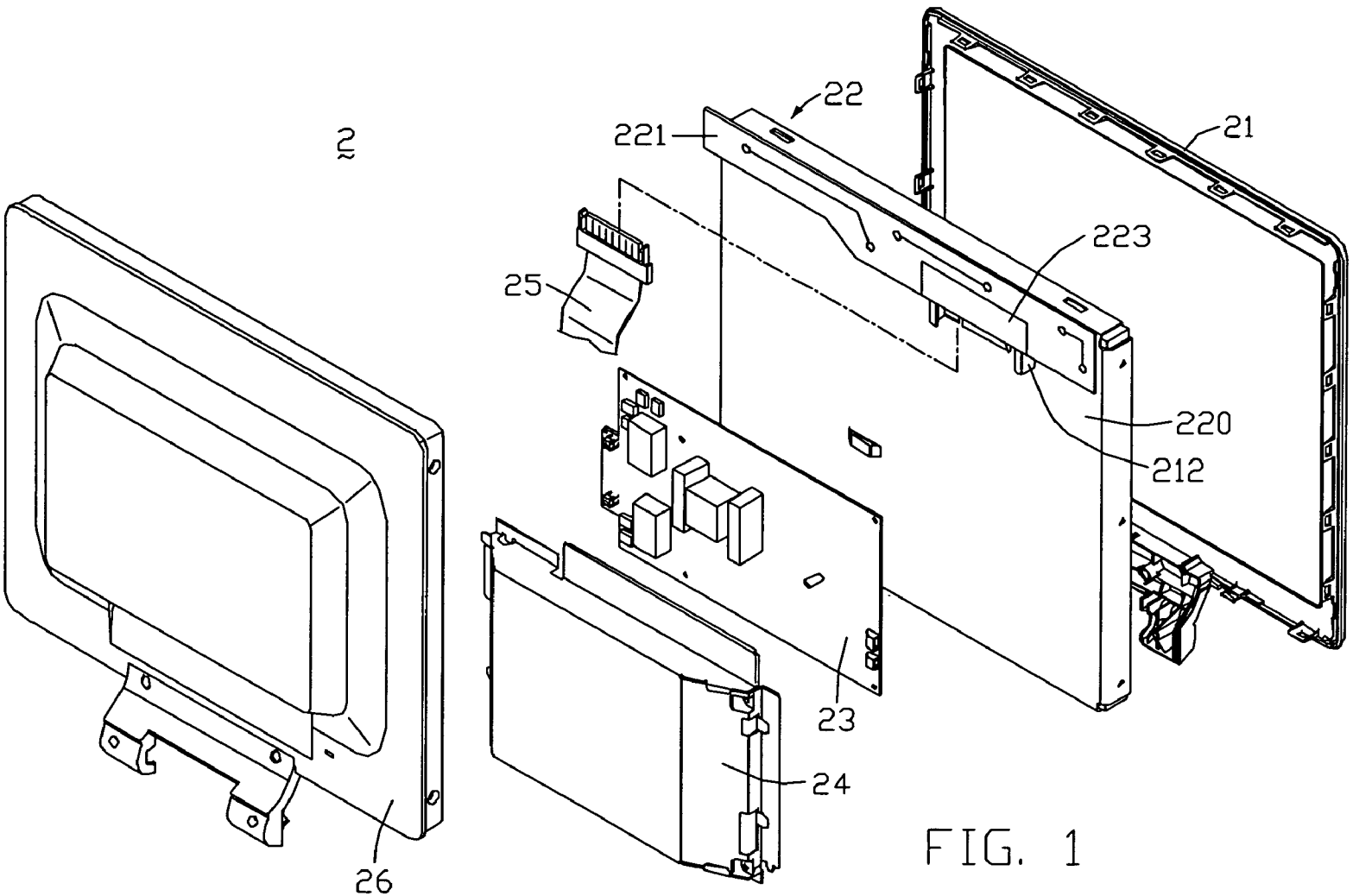
FIG. 1 is an exploded, isometric view of a display device according to an exemplary embodiment of the present invention.

FIG. 1 is an exploded, isometric view of a display device according to an exemplary embodiment of the present invention. The display device 2 includes a front cover 21, a display module 22, a power supply circuit 23, a shield case 24, a cable 25, and a rear cover 26. The front cover 21 coupled with the rear cover 26 defines a closed space there between. The display module 22, the power supply circuit 23, the shield case 24, and the cable 25 are received in the closed space.

The power supply circuit 23 is disposed between the shield case 24 and the display module 22. The power supply circuit 23 is electrically coupled to the display module 22 by the cable 25. The display module 22 includes a backboard 220, and a printed circuit board 221 disposed on the backboard 220. The printed circuit board 221 includes a female electrical connector 223. The backboard 220 includes an orienting structure 212 corresponding to the female connector 223.

Figure 2:
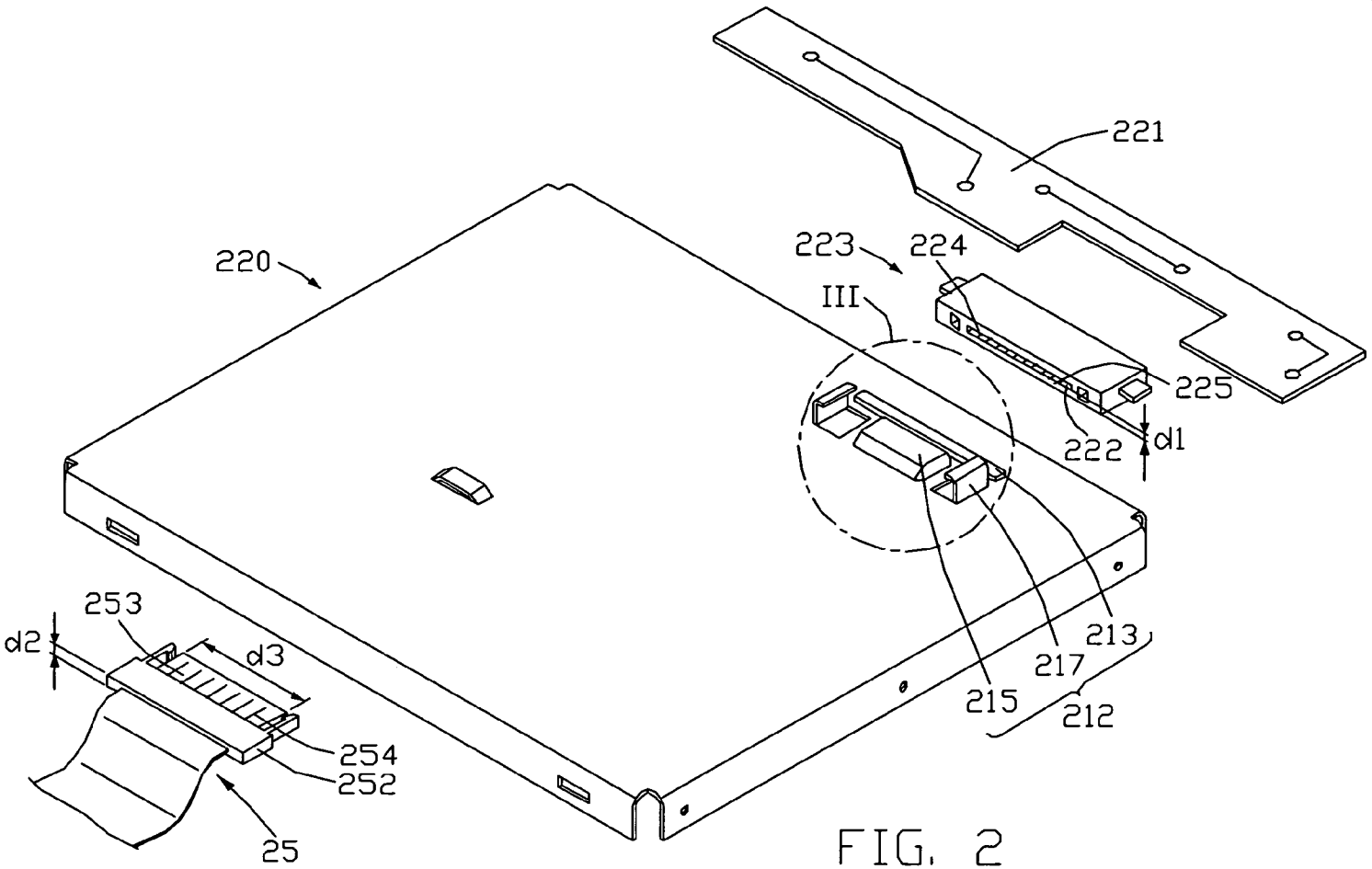
FIG. 2 is an exploded, isometric view of certain parts of the display device of FIG. 1.

FIG. 2 is an exploded, isometric view of certain parts only of the display device 2. The female connector 223 includes a rectangular groove 222 facing the orienting structure 212, and a plurality of contact fingers 224 formed at inner surfaces of the groove 222. A bottom side of the groove 222 is bounded by a side wall 225. The side wall 225 has a thickness d1.

One terminal of the cable 25 includes a male electrical connector 252, corresponding to the female connector 223 of the printed circuit board 221. The male connector 252 has a thickness d2, and includes a rectangular protrusion 253 corresponding to the groove 222 of the female connector 223. The rectangular protrusion 253 has a width d3, and includes a plurality of contact fingers 254 corresponding to the contact fingers 224 of the female connector 223. The contact fingers 254 of the male connector 252 are formed at outer surfaces of the rectangular protrusion 253.

Figure 3:
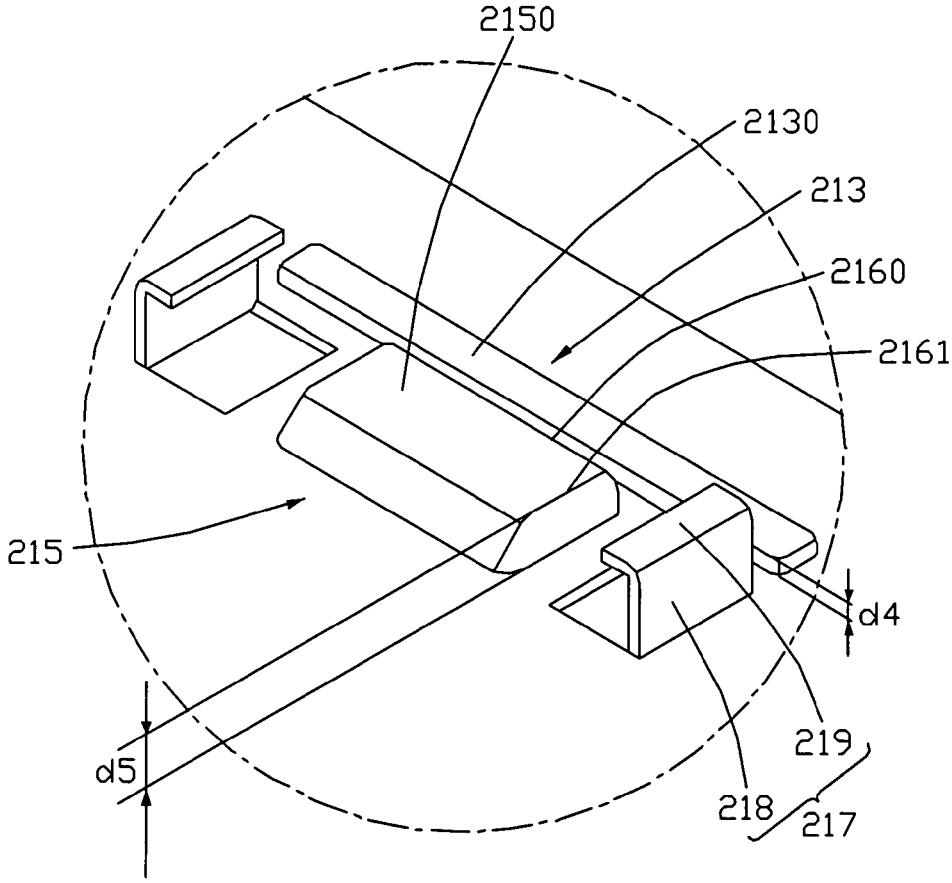
FIG. 3 is an enlarged view of a circled portion III of FIG. 2.

Referring also to FIG. 3, the orienting structure 212 includes two locating units 217, a first supporting bump 215 disposed between the locating units 217 for supporting the male connector 252, and a second supporting bump 213 for supporting the female connector 223. Each of the locating units 217 is formed by means of impact extrusion.

The second supporting bump 213 is disposed on the backboard 220, and is adjacent to the printed circuit board 221. The second supporting bump 213 can for example be an integral portion of the backboard 220 formed by impact extrusion. The second supporting bump 213 has a thickness d4. The female connector 223 is disposed on a top surface 2130 of the second supporting bump 213. That is, the distance from the backboard 220 to the bottom side of the groove 222 of the female connector 223 is d1+d4.

The first supporting bump 215 is disposed on the backboard 220 corresponding to the groove 222 of the female connector 223. The first supporting bump 215 has a thickness d5. The first supporting bump 215 can for example be an integral portion of the backboard 220 formed by impact extrusion. The first supporting bump 215 includes a top surface 2150 for supporting the male connector 252. The distance from the backboard 220 to the top surface 2150 of the first supporting bump 215 is equal to the distance from the backboard 220 to the bottom surface of the groove 222 of the female connector 223. That is, the thickness d5 of the first supporting bump 215 is substantially equal to d1+d4. Therefore, the top surface 2150 of the first supporting bump 215 is substantially in the same horizontal plane with a top surface (not labeled) of the side wall 225 that bounds the groove 222 of the female connector 223.

The top surface 2150 of the first supporting bump 215 has a rectangular shape. The top surface 2150 includes a long side 2160, and two opposite short sides 2161 perpendicular to the long side 2160. The long side 2160 is adjacent and parallel to the second supporting bump 213.

The locating units 217 are disposed beside the short sides 2161 of the first supporting bump 215 respectively. The locating units 217 are symmetrically oriented with respect to each other. Each of the locating units 217 has an L-shaped profile. That is, each of the locating units 217 includes a short arm 219 parallel to the backboard 220, and a long arm 218 perpendicular to both the backboard 220 and the short arm 219. The two long arms 218 are parallel to each other. The first supporting bump 215 is disposed between the long arms 218 and below the short arms 219 of the locating units 217. In the illustrated embodiment, the locating units 217 and the first supporting bump 215 are all spaced a same distance from the second supporting bump 213.

Both of the short arms 219 of the locating units 217 extend generally toward the first supporting bump 215. A vertical distance from an inner surface of the short arm 219 of each locating unit 217 to the top surface 2150 of the first supporting bump 215 is equal to the thickness d2 of the male connector 252. The long arms 218 integrally extend up from a main body (not labeled) of the backboard 220. A distance between inner surfaces of the two long arms 218 is equal to the width d3 of the protrusion 253 of the male connector 252. Therefore, the first supporting bump 215 in cooperation with the locating units 217 define a sliding track (not labeled), which can be used for aligning the male connector 252 with the groove 222 of the female connector 223. The long arms 218 of the locating units 217 function as guides for blocking movement along a first horizontal axis of the sliding track. The first supporting bump 215 in cooperation with the short arms 218 of the locating units 217 function as guides for blocking movement along a second vertical axis of the sliding track. That is, the second axis is perpendicular to the first axis.

Figure 4:
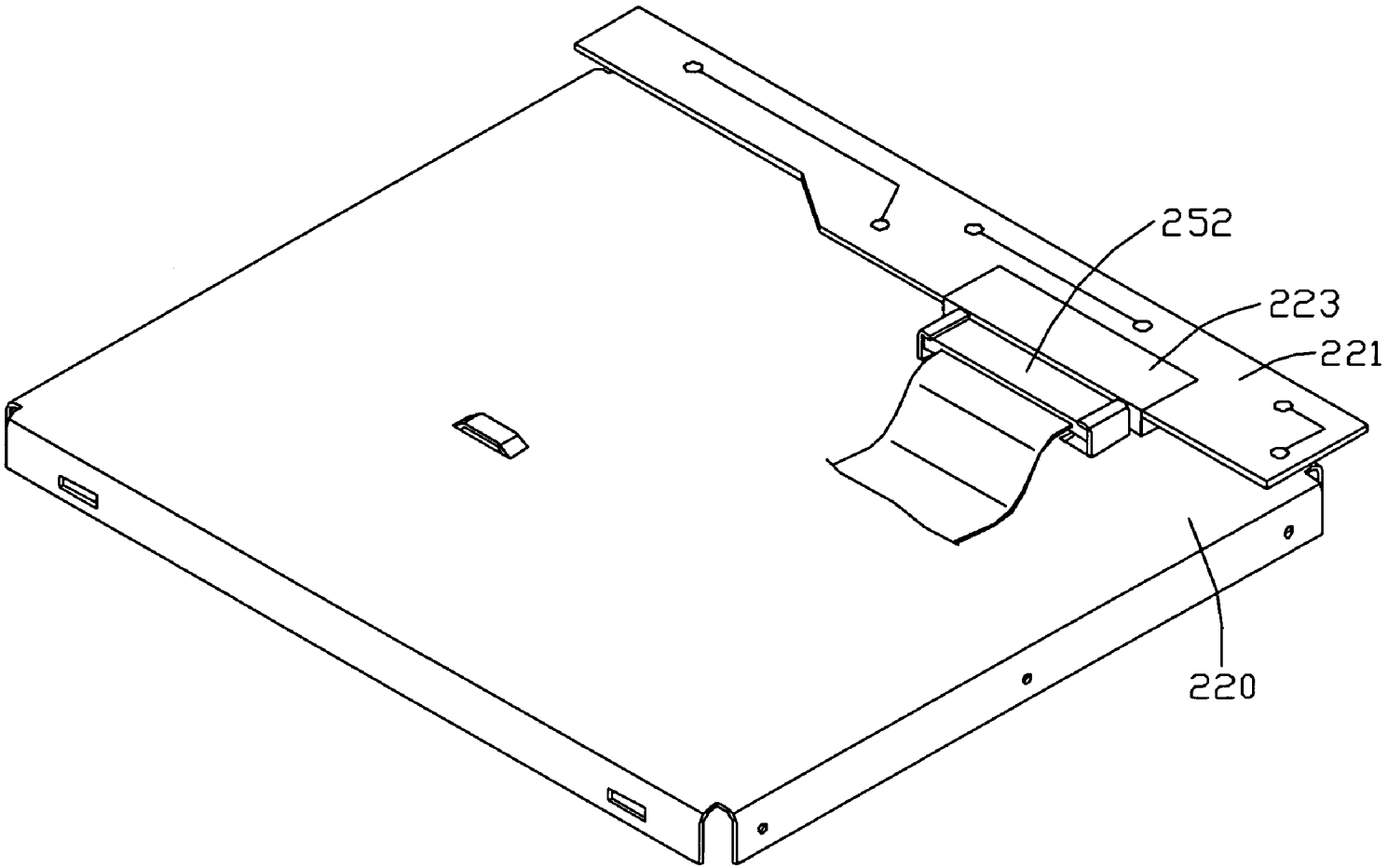
FIG. 4 is an assembled view of the parts of the display device shown in FIG. 2.
Figure 5:
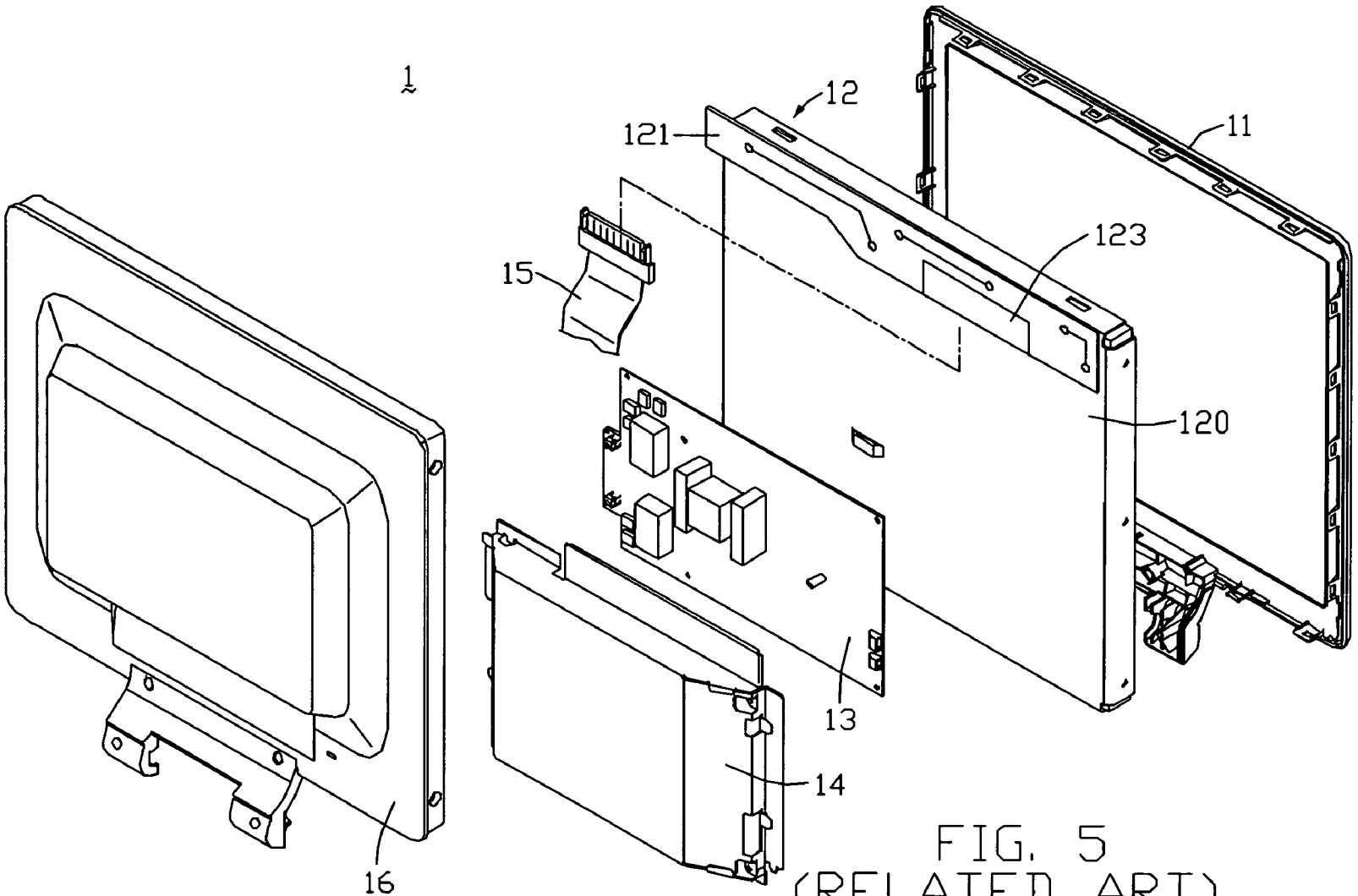
FIG. 5 (RELATED ART)
FIG. 5 is an exploded, isometric view of a conventional display device.
Figure 6:
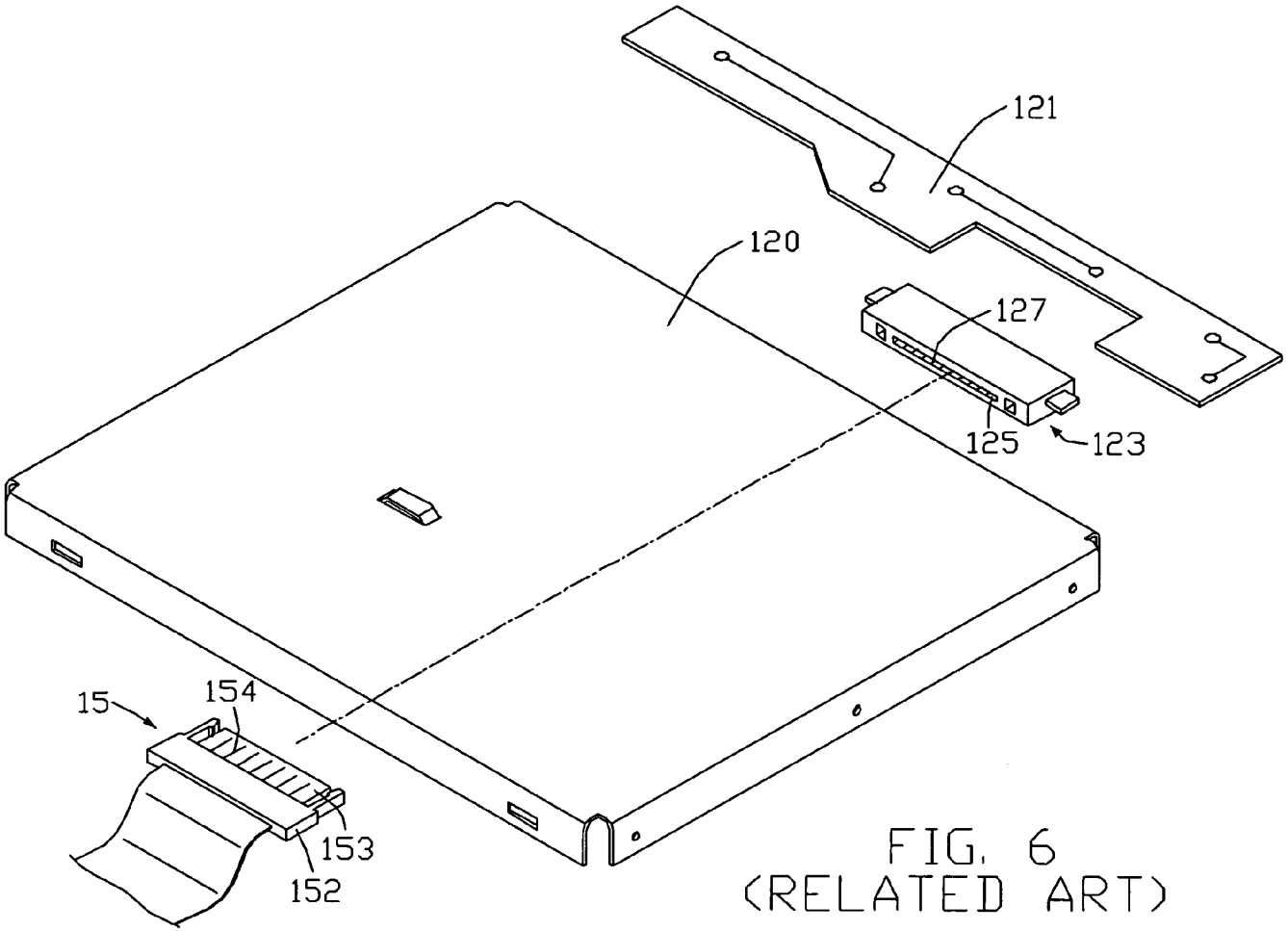
FIG. 6 (RELATED ART)
FIG. 6 is an exploded, isometric view of certain parts of the display device of FIG. 5.
Figure 7:
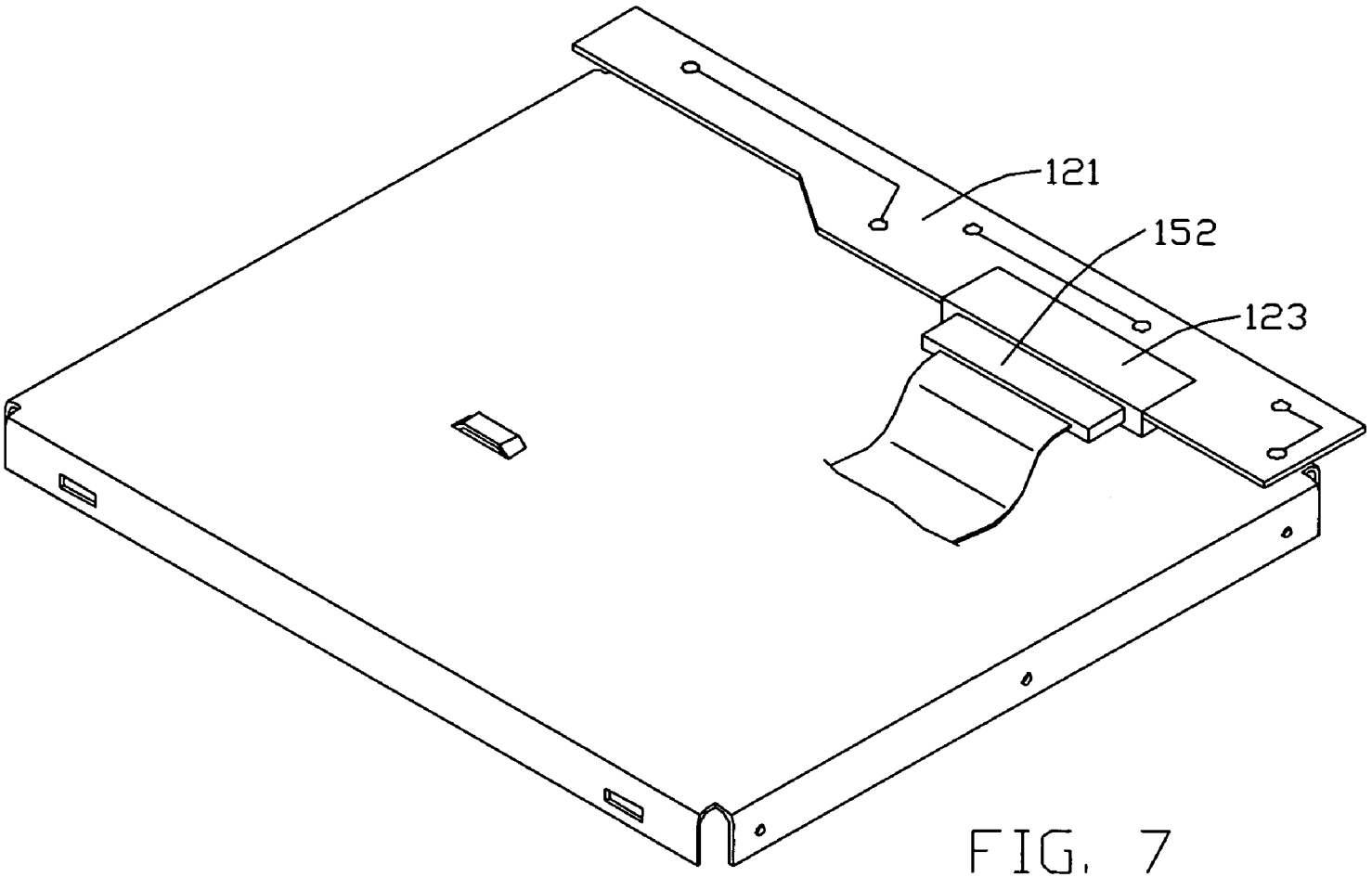
FIG. 7 (RELATED ART)
FIG. 7 is an assembled view of the parts of the display device shown in FIG. 6.

Referring also to FIG. 4, this is an assembled view of the parts of the display device 2 shown in FIG. 2. The male connector 252 is disposed so that it rests on a sloped surface (not labeled) of the first supporting bump 215 of the orienting structure 212, generally between the locating units 217. The female connector 223 is disposed on the second supporting bump 213, so that the groove 222 of the female connector 234 is aligned with the sliding track. Then the male connector 252 is pushed toward the female connector 223 along the sliding track in a horizontal direction perpendicular to both the first and second axes of the sliding track. Thereby, the protrusion 253 of the male connector 252 is inserted into the groove 222 of the female connector 234, with the contact fingers 225 of the female connector 234 contacting the contact fingers 254 of the male connector 252. Thereby, the power supply circuit 23 is electrically coupled to the printed circuit board 221 of the display module 12.

With the above-described configurations, the first supporting bump 215 and the locating units 217 of the orienting structure 212 cooperatively define the sliding track. The groove 222 of the female connector 223 is aligned with the sliding track at a same height. Further, the female connector 223 can be slid in sideways directions while resting on the second supporting bump 213 so that a position of the groove 222 of the female connector 223 along a side-to-side axis is at least approximately aligned with the sliding track. Thereby, the protrusion 253 of the male connector 252 can be easily and correctly inserted into the groove 222 of the female connector 223 when the male connector 252 is guided along the sliding track. As a result, mis-insertion and improper engagement of the contact fingers 224, 254 is avoided, thereby avoiding damage occurring to the male connector 252 or the female connector 223. Accordingly, the power signals from the power supply circuit 23 can be transmitted to the display module 22 correctly and reliably. Thereby, the display device 2 operates correctly and reliably.

After the male connector 252 is connected to the female connector 223 via the orienting structure 212, the male connector 252 remains in position in the orienting structure 212. That is, the male connector 252 is held in position at the backboard 220 by the orienting structure 212. In addition, the female connector 223 can be fixed on the second supporting bump 213 by conventional means. Alternatively, the printed circuit board 221 may be fixed in position, whereby the female connector 223 is securely held in position on the second supporting bump 213. Furthermore, the orienting structure 212 and the male connector 252 can be sized so that the male connector 252 is interferingly slid along the sliding track to engage with the female connector 223; and once engaged, the male connector 252 is tightly held in position by frictional engagement with the orienting structure 212. Moreover, the protrusion 253 of the male connector 252 is tightly held in position in the groove 222 of the female connector 223. For any and various of the above reasons, the male connector 252 and the female connector 223 can be securely and reliably held in position.

It is to be further understood that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An orienting structure for facilitating connecting a male electrical connector and a female electrical connector together, the orienting structure comprising:

two locating units, each of the locating units comprising a first portion and a second portion perpendicular to the first portion;

a first supporting bump disposed between the first portions of the locating units, and below the second portions of the locating units; and a second supporting bump spaced a same distance from the first supporting bump and the locating units;

wherein the first supporting bump and the locating units cooperatively define a sliding track configured for slidingly receiving the male connector, the female connector is disposed on the second supporting bump and aligned with the sliding track;

the first portions of the locating units function as guides for blocking movement along a first axis of the sliding track, the first supporting bump in cooperation with the second portions of the locating units function as guides for blocking movement along a second axis of the sliding track, and the first direction is perpendicular to the second direction; and when the male connector is slid along the sliding track, the sliding is in a direction perpendicular to both the first and second axes of the sliding track.

2. The orienting structure as claimed in claim 1, wherein the locating units are symmetrically oriented with respect to each other.

3. The orienting structure as claimed in claim 1, wherein the first portions of the locating units are parallel to each other.

4. The orienting structure as claimed in claim 1, wherein the second portions of the locating units are parallel to the first supporting bump.

5. The orienting structure as claimed in claim 1, wherein each of the locating units has an L-shaped profile.

6. The orienting structure as claimed in claim 5, wherein each of the locating units includes a long arm and a short arm, the long arm is perpendicular to the short arm, and the short arm is parallel to the first supporting bump.

7. A display device, comprising:

a backboard;

a female electrical connector;

a male electrical connector; and an orienting structure comprising:

two locating units disposed on the backboard, each of the locating units comprising a first portion and a second portion perpendicular to the first portion;

a first supporting bump disposed on the backboard and between the first portions of the locating units;

a second supporting bump disposed on the backboard and spaced a same distance from the first supporting bump and the locating units wherein the first supporting bump is disposed below the second portions of the locating units, the first supporting bump and the locating units cooperatively define a sliding track configured for slidingly receiving the male connector, the female connector is disposed at the second supporting bump and aligned with the sliding track;

the first portions of the locating units function as guides for blocking movement along a first axis of the sliding track, the first supporting bump in cooperation with the second portions of the locating units function as guides for blocking movement along a second axis of the sliding track, and the first direction is perpendicular to the second direction; and when the male connector is slid toward the female connector along the sliding track, the sliding is in a direction perpendicular to both the first and second axes of the sliding track.

8. The orienting structure as claimed in claim 7, wherein the locating units are symmetrically oriented with respect to each other.

9. The orienting structure as claimed in claim 7, wherein the second portions of the locating units are parallel to the first supporting bump.

10. The display device as claimed in claim 7, wherein the female connector is aligned with the sliding track at a same height.

11. The display device as claimed in claim 7, wherein each of the locating units has an L-shaped profile.

12. The display device as claimed in claim 11, wherein each of the locating units includes a long arm and a short arm, the long arm is perpendicular to both the short arm and backboard, the short arm is parallel to the first supporting bump.

13. The display device as claimed in claim 12, wherein a distance from an inner surface of the short arm to a top surface of the first supporting bump is equal to a thickness of the male connector.

14. The display device as claimed in claim 12, wherein the female connector comprises a groove, a distance from the backboard to a top surface of the first supporting bump is equal to a distance from the backboard to a bottom side of the groove.

15. The display device as claimed in claim 14, wherein a distance between inner surfaces of the short arms of the locating units is equal to the width of the groove of the female connector.

16. The display device as claimed in claim 14, wherein the male connector comprises a protrusion corresponding to the groove of the female connector.

17. The display device as claimed in claim 16, wherein the protrusion of the male connector has a width equal to a width of the groove of the female connector.

18. The display device as claimed in claim 7, further comprising a cable, the male connector coupling to one terminal of the cable.

19. The display device as claimed in claim 18, further comprising a power supply circuit, the power supply circuit coupling to the other terminal of the cable.

20. A display device, comprising:

a backboard;

a female electrical connector;

a male electrical connector; and an orienting structure comprising:

two locating units disposed on the backboard, each of the locating units comprising a first portion and a second portion perpendicular to the first portion;

a first supporting bump disposed on the backboard and between the first portions of the locating units;

a second supporting bump disposed on the backboard and spaced a same distance from the first supporting bump and the locating units wherein the first supporting bump is disposed below the second portions of the locating units, the first supporting bump and the locating units cooperatively define a sliding track configured for slidingly receiving the male connector, the female connector is disposed at the second supporting bump and aligned with the sliding track;

the first portions of the locating units function as guides for blocking movement along a first axis of the sliding track, the first supporting bump in cooperation with the second portions of the locating units function as guides for blocking movement along a second axis of the sliding track, and the first direction is perpendicular to the second direction; and the male connector is slid toward the female connector along the sliding track, the sliding is in a direction perpendicular to both the first and second axes of the sliding track, when the male connector is connected to the female connector, the male connector is held in position by the locating units and the first supporting bump.

* * * * *